US011053813B2

(12) United States Patent
Tibbetts et al.

(10) Patent No.: US 11,053,813 B2
(45) Date of Patent: Jul. 6, 2021

(54) TURBINE COMPONENT CLEANING SYSTEM AND METHOD HAVING DETERGENT RECOVERY AND REGENERATION

(71) Applicant: General Electric Company, Schenectady, NY (US)

(72) Inventors: Nicole Jessica Tibbetts, Delanson, NY (US); Rob Ray Anthony, Mason, OH (US); Brian William Pfeiffer, West Chester, OH (US); Michael Edward Eriksen, Cincinnati, OH (US); Keith Anthony Lauria, Wells, NY (US); Bernard Patrick Bewlay, Schenectady, NY (US); Ambarish Jayant Kulkarni, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 15/490,642

(22) Filed: Apr. 18, 2017

(65) Prior Publication Data

US 2018/0298781 A1 Oct. 18, 2018

(51) Int. Cl.
*F01D 25/00* (2006.01)
*C11D 11/00* (2006.01)
(Continued)

(52) U.S. Cl.
CPC ..... *F01D 25/002* (2013.01); *B08B 3/003* (2013.01); *B08B 3/02* (2013.01); *B08B 9/00* (2013.01);
(Continued)

(58) Field of Classification Search
None
See application file for complete search history.

(56) References Cited

U.S. PATENT DOCUMENTS 3,037,887 A * 6/1962 Brenner ..... B08B 3/003 134/22.18
5,661,117 A 8/1997 Dufresne
(Continued)

FOREIGN PATENT DOCUMENTS

WO 02090482 A1 11/2002
WO 2007102738 A1 9/2007

OTHER PUBLICATIONS

"On-Wing Washing System Using Injected Water or Detergent Which Penetrates Deep into the Engine, Cleaning Performance Stealing Contaminants", Aero Jet Wash L.L.C.; downloaded Dec. 2016; http://www.aerojetwash.com/services.html.
(Continued)

*Primary Examiner* — Cristi J Tate-Sims
(74) *Attorney, Agent, or Firm* — Dority & Manning, P.A.

(57) ABSTRACT

A turbine engine cleaning system includes a foam generator configured to generate foam, from a liquid detergent, to clean a turbine engine. The turbine engine cleaning system also includes an effluent capture and detergent regeneration sub-system having an inlet configured to receive an effluent from the turbine engine, processing components configured to process the effluent to regenerate a liquid detergent, and an outlet fluidly coupled with the foam generator to enable transport of the liquid detergent from the effluent capture and detergent regeneration sub-system to the foam generator.

20 Claims, 5 Drawing Sheets

(51) Int. Cl.
*B08B 9/00* (2006.01)
*B08B 3/00* (2006.01)
*B08B 3/02* (2006.01)

(52) U.S. Cl.
CPC ..... *C11D 11/0041* (2013.01); *C11D 11/0058* (2013.01); *C11D 11/0076* (2013.01); *F05D 2220/32* (2013.01)

(56) References Cited

U.S. PATENT DOCUMENTS 5,899,217 A 5/1999 Testman
6,425,955 B1 * 7/2002 Hacias ..... C11D 3/044 134/10
7,018,965 B2 * 3/2006 Yan ..... C11D 3/364 510/185
8,277,647 B2 * 10/2012 Rice ..... B08B 17/00 210/171
8,628,627 B2 1/2014 Sales
2007/0034237 A1 * 2/2007 Stockert ..... B08B 3/00 134/18
2007/0125520 A1 6/2007 Nutsos
2009/0107930 A1 * 4/2009 Goldman ..... B01D 29/58 210/806
2015/0159122 A1 6/2015 Tibbetts et al.
2015/0361608 A1 * 12/2015 Pollett ..... D06F 33/00 68/12.04
2016/0230592 A1 * 8/2016 Saenz ..... F01D 25/002

OTHER PUBLICATIONS

"Gas Turbine Cleaning", Engine Cleaning Technology, Inc.; downloaded Dec. 2016; https://www.ectinc.net/industrialGasTurbine.html.

* cited by examiner

TURBINE COMPONENT CLEANING SYSTEM AND METHOD HAVING DETERGENT RECOVERY AND REGENERATION

BACKGROUND

The subject matter disclosed herein relates to a cleaning system and method for a turbine engine (e.g., an aircraft engine) and, more specifically, to an in-line effluent capture and detergent regeneration sub-system (e.g., of the cleaning system).

Gas turbine engines (e.g., aircraft engines), or turbine systems, typically combust a mixture of carbonaceous fuel and compressed oxidant to generate high temperature, high pressure combustion gases. The combustion gases drive a turbine, which is coupled via a shaft to a compressor. In some embodiments, the shaft may also be coupled to an electrical generator, or some other load such as a propeller (or fan). Accordingly, as the combustion gases drive the turbine and corresponding shaft into rotation, the shaft is utilized to output power (e.g., to the electrical generator, the propeller (or fan), some other load, or some combination thereof). In certain aircraft engines, the combustion gases may pass through the turbine and through a nozzle. Acceleration of the combustion gases through the nozzle may generate thrust for the aircraft.

Unfortunately, turbine systems are generally susceptible to deposits or contaminants, such as dust in particular, which may reduce efficiency and/or effectiveness of the turbine system. The contaminants may be formed or may gather in any component of the gas turbine engine, including but not limited to the compressor, the combustor or combustion chamber, and the turbine. Traditional cleaning systems may be large, may require the use of expensive materials (e.g., detergent), and may not effectively or efficiently address (e.g., dispose of) contaminants (e.g., solids, particulate, and organics).

BRIEF DESCRIPTION

In one embodiment, a turbine engine cleaning system includes a foam generator configured to generate foam, from a liquid detergent, to clean a turbine engine. The turbine engine cleaning system also includes an effluent capture and detergent regeneration sub-system having an inlet configured to receive an effluent from the turbine engine, processing components configured to process the effluent to regenerate a liquid detergent, and an outlet fluidly coupled with the foam generator to enable transport of the liquid detergent from the effluent capture and detergent regeneration sub-system.

In a second embodiment, a method of cleaning a turbine engine with a foam generated from a liquid detergent includes the following steps. The method includes contacting the turbine engine with the foam to remove contaminants from the turbine engine, thereby generating an effluent having the contaminants. The method also includes removing the effluent from the turbine engine, forming a liquid mixture from the effluent such that the liquid mixture comprises the contaminants, and treating the liquid mixture with processing components to remove the contaminants, and to generate the liquid detergent.

A third embodiment includes a cleaning station sized to house components utilized during a cleaning cycle of a turbine engine with a foam generated from a liquid detergent, and to regenerate the liquid detergent from an effluent output of the cleaning cycle. The cleaning station includes a foam generator configured to aerate the liquid detergent to generate the foam. The cleaning station also includes an effluent capture and detergent regeneration sub-system having processing components configured to receive the effluent output, to treat the effluent output to generate the liquid detergent, and to deliver the liquid detergent to a liquid detergent storage tank in fluid communication with the foam generator.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
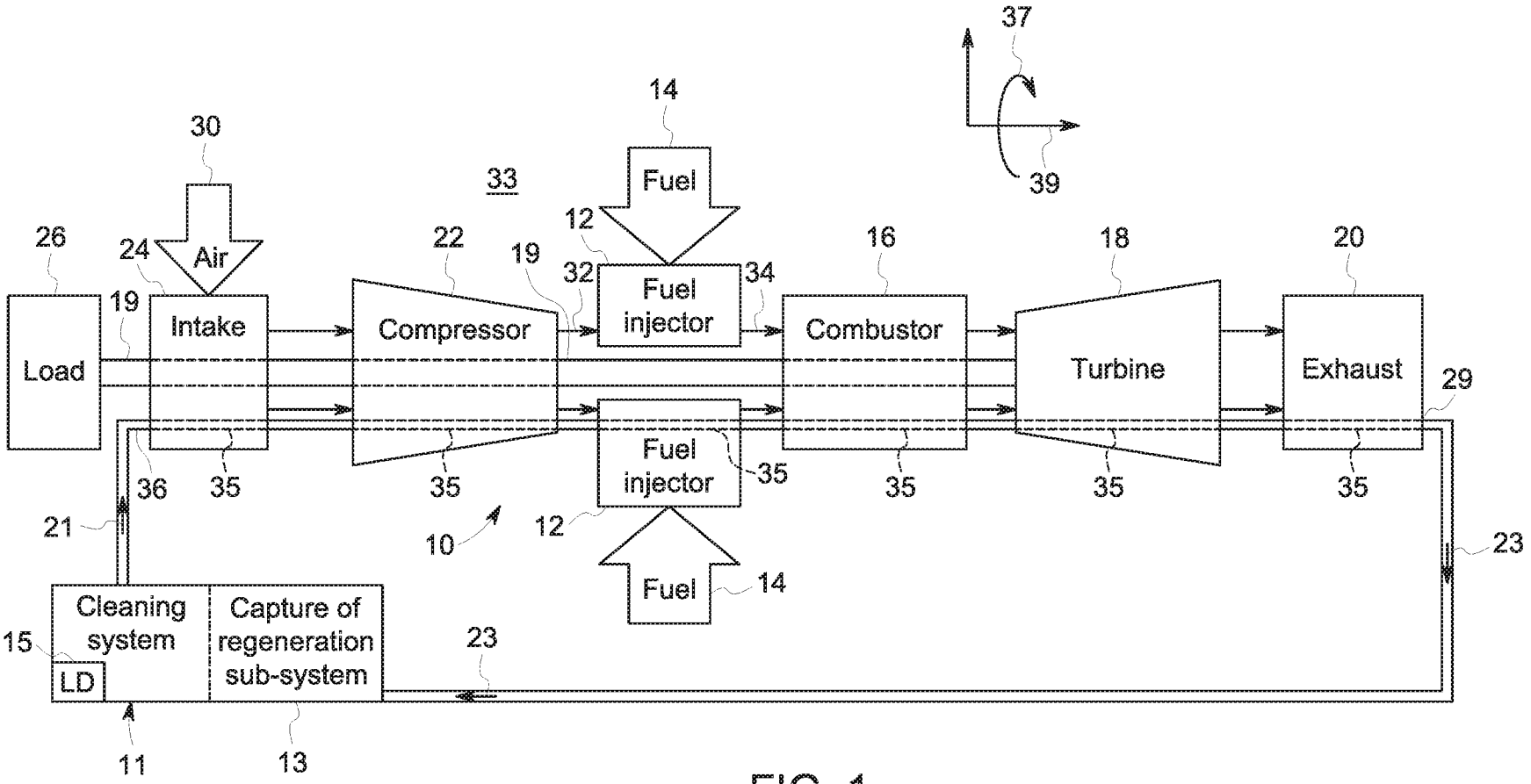
FIG. 1 is a cross-sectional schematic view of an embodiment of a turbine system and a cleaning system having an effluent capture and detergent regeneration sub-system, in accordance with an aspect of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

The present disclosure relates to a cleaning system and method for a turbine system or engine (e.g., an aircraft engine) and, more specifically, to an in-line effluent capture and detergent regeneration sub-system (of the cleaning system). For example, gas turbine engines (e.g., aircraft engines), or turbine systems, typically combust a mixture of carbonaceous fuel and compressed oxidant to generate high-temperature, high-pressure combustion gases. Unfortunately, turbine systems are generally susceptible to contaminants, such as dust, which may reduce efficiency and/or effectiveness of the turbine system. The contaminants may include pollutants (e.g., sulfate, nitrates, etc.), evaporate deposits (e.g., halite, carbonates, etc.), and dust (e.g., aluminosilicate clays).

Generally, contaminants may be formed or may gather in any component of the gas turbine engine, including, but not limited to, a compressor, a combustor or combustion chamber, and a turbine. Contaminants gathered on the walls of turbine components may cause temperatures of the components, or proximate the components, that exceed a temperature threshold (e.g., preferred operating design temperature) of the thermal barrier coating (TBC) of the turbine components. Thus, a cleaning system may be employed to generate a foam from a liquid detergent (e.g., organic acid based liquid detergent, such as glycolic acid and/or citric acid based liquid detergent), and to distribute the foam to the components of the turbine system requiring cleaning.

Unfortunately, traditional cleaning systems may be large, expensive, wasteful, and inefficient. For example, traditional cleaning systems generally dispose of the effluent following (or during) a cleaning cycle, thereby requiring expensive new liquid detergent for each cycle. In the harshest conditions in which frequent cleaning of the engine is most important, the cost of detergent/water may be generally higher than in more amenable conditions, thereby compounding the material expense described above. Further, because traditional cleaning systems do not generally recycle detergent, during or after a cleaning cycle, traditional cleaning systems may require larger detergent reservoirs that could otherwise be reduced in volume if the detergent were recycled throughout (e.g., during) a cleaning procedure as presently recognized. Further still, because traditional cleaning systems dispose of detergent following (or during) a cleaning, it is presently recognized that solids, particulate, and organics may not be adequately addressed (e.g., separated from the content flushed from the turbine during a cleaning, and disposed of or re-used for other purposes).

Embodiments of the present disclosure are directed toward turbine component cleaning systems, or an effluent capture and detergent regeneration sub-system thereof, having some combination of the following components or assemblies: an effluent capture component or assembly for capturing effluent after (or during) a cleaning cycle, an effluent converter component or assembly for converting the captured effluent to a liquid mixture, an analyzer for analyzing the liquid mixture to determine its contents and composition, a first filtration component or assembly for removal of organics from the liquid mixture, a second filtration component or assembly for removal of solids and particulate from the liquid mixture, a chemical converter for converting the liquid mixture back to the formulation of the initial liquid detergent (e.g., organic acid based liquid detergent, such as glycolic acid and/or citric acid based liquid detergent) utilized to form the foam, or a suitable or acceptable formula having the specification limits of the detergent used to generate the foam, and a delivery component or assembly for delivering the liquid detergent back to the liquid detergent storage tank (or to a recycled detergent tank separate from a virgin detergent tank).

It should be noted that, in certain embodiments, the disclosed system is capable of cleaning the turbine engine while simultaneously treating the effluent output of the cleaning cycle, and while simultaneously generating the foam. Because the system may include a closed-loop having both the cleaning and regeneration components therein, at least a portion of the liquid detergent may be utilized at least twice during a single cleaning cycle, thereby substantially reducing a size of a liquid detergent storage tank required for the system, and thereby substantially reducing material costs of the expensive liquid detergent (e.g., organic acid based liquid detergent, such as glycolic acid and/or citric acid based liquid detergent). Additionally, re-use of the detergent during the cleaning cycle may minimize a total volume of liquid waste and associated disposal cost post-cleaning. These and other features will be described in detail with reference to the figures below.

Turning now to the drawings, FIG. 1 is a block diagram of a turbine system 10 and an embodiment of a cleaning system 11 designed and arranged to clean the turbine system 10, where the cleaning system 11 includes an in-line effluent capture and detergent regeneration sub-system 13, which may be referred to in certain portions of the specification below as "the sub-system 13". The cleaning system 11 and corresponding sub-system 13 may form a closed loop by which foam 21 is generated from a liquid detergent 15, and by which liquid detergent 15 is re-generated from an effluent 23 output of the turbine cleaning process. It should be noted that the illustrated turbine system 10 is exemplary and non-limiting. For example, to the extent the illustrated turbine system 10 includes components that would not be included in other turbine systems, or to the extent the illustrated turbine system 10 does not include components that would be included in other turbine systems, the differences in the other turbine systems would not necessarily preclude the uses or advantages of the illustrated cleaning system 11 and its corresponding sub-system 13 described herein.

The illustrated turbine system 10 includes a fuel injector 12, a fuel supply 14, a combustor 16, and a turbine 18. As illustrated, the fuel supply 14 routes a liquid fuel and/or gas fuel, such as natural gas, to the gas turbine system 10 through the fuel injector 12 and into the combustor 16. As discussed below, the fuel injector 12 is designed to inject and mix the fuel with compressed air. The combustor 16 ignites and combusts the fuel-air mixture, and then passes hot pressurized exhaust gas into the turbine 18, which includes one or more stators having fixed vanes or blades, and one or more rotors having blades which rotate relative to the stators. The exhaust gas passes over the turbine rotor blades, thereby driving the turbine rotor to rotate. Coupling between the turbine rotor and a shaft 19 will cause the rotation of the shaft 19, which is also coupled to several components throughout the gas turbine system 10, as illustrated. Eventually, the exhaust of the combustion process may exit the gas turbine system 10 via an exhaust outlet 20. In some embodiments, the gas turbine system 10 may be a gas turbine system of an aircraft, in which the exhaust outlet 20 may be a nozzle through which the exhaust gases are accelerated. Acceleration of the exhaust gases through the exhaust outlet 20 (e.g., the nozzle) may provide thrust to the aircraft. As described below, the shaft 19 (e.g., in an aircraft gas turbine system 10) may be coupled to a propeller (or fan), which may provide thrust to the aircraft in addition to, or in place of, the exhaust gases accelerated through the exhaust outlet 20 (e.g., the nozzle).

A compressor 22 includes blades rigidly mounted to a rotor which is driven to rotate by the shaft 19. As air passes over the rotating blades, air pressure increases, thereby providing the combustor 16 with sufficient air for proper combustion. The compressor 22 may intake air to the gas turbine system 10 via an air intake 24. Further, the shaft 19 may be coupled to a load 26, which may be powered via rotation of the shaft 19. As will be appreciated, the load 26 may be any suitable device that may use the power of the rotational output of the gas turbine system 10, such as a power generation plant or an external mechanical load. For example, the load 26 may include an electrical generator, a propeller (or fan) of an airplane as previously described, and so forth. The air intake 24 draws air 30 into the gas turbine system 10 via a suitable mechanism, such as a cold air intake. The air 30 then flows over the blades of the compressor 22, which provides compressed air 32 to the combustor 16. In particular, the fuel injector 12 may inject the compressed air 32 and fuel 14, as a fuel-air mixture 34, into the combustor 16. Alternatively, the compressed air 32 and fuel 14 may be injected directly into the combustor for mixing and combustion.

As various fluids, solids, and/or airborne particulate are introduced to the turbine system 10, the turbine system 10 may require periodic cleaning. For example, the turbine system 10 may be susceptible to the accumulation of deposits or contaminants (e.g., solids, particulates, dust, organics) within components of the turbine system 10. The contaminants may include pollutants (e.g., sulfate, nitrates, etc.), evaporate deposits (e.g., halite, carbonates, etc.), and dust (e.g., aluminosilicate clays). Contaminants collected on the walls of turbine components may cause temperatures of the components, or proximate the components, that exceed a temperature threshold (e.g., preferred operating design temperature) of a thermal barrier coating (TBC) of certain turbine components. Accordingly, as illustrated, the turbine system 10 includes the cleaning system 11 fluidly coupled to at least one component of the turbine system 10, namely, the air intake(s) 24, the compressor 22, the fuel injector(s) 12, the combustor(s) 16, the turbine 18, and/or the exhaust outlet 20. In some embodiments, the cleaning system 11 may be physically coupled to only one component or one group of components of the gas turbine system 10, such as to the air intake or intakes 24, or to the compressor 22. For example, although the components of the turbine system 10 are shown separate from one another in the illustrated embodiment, the components may be integral with each other or coupled together such that a fluid passageway 35 extends through inner portions of all the components. The fluid passageway 35 may be substantially continuous through the components and/or may be at least partially sealed from an environment 33 outside the gas turbine system 10.

Although the fluid passageway 35 is shown on only a bottom portion of the illustrated gas turbine system 10, the fluid passageway 35 may be an annular passageway extending in an annular direction 37 about a longitudinal direction 39 (or axis) of the gas turbine system 10. The cleaning system 11 may be physically coupled to one of the components (e.g., a first of the components, such as the air intake[s] 24 or the compressor 22) at an inlet 36, such that the cleaning system 11 is fluidly coupled to the fluid passageway 35 at the inlet 36. It should be noted that, in some embodiments, the cleaning system 11 may include a delivery system or manifold that is coupled to a number of inlets to the fluid passageway 35 of the gas turbine system 10 (e.g., an engine inlet). For example, the delivery system or manifold of the cleaning system 11 may deliver cleaning agents (e.g., a detergent-based foam 21) to inlets of the gas turbine system 10 (e.g., engine inlets), and/or to other inlets that are also used for borescope injection, as fuel injection nozzles, for igniter plugs, or any other suitable inlets. Further, by way of introducing the detergent-based foam 21 to the fluid passageway 35 through one or more inlets to the fluid passageway 35 (e.g., through borescope inspection ports, through igniter plug inlets, through fuel nozzles, etc.), the detergent-based foam 21 may pass over compressor blades, compressor vanes, through the compressor, through and/or outside of the turbine, and through cooling circuits of the turbine system 10.

The cleaning system 11 in FIG. 1 is designed to generate, and to provide to the component(s) of the gas turbine system 10, a detergent-based foam 21 that loosens, soaks, absorbs, and/or cleans the deposits or contaminants within the components of the gas turbine system 10. The cleaning system 11 may also include the effluent capture and detergent regeneration sub-system 13, in certain embodiments. Although the sub-system 13 is illustrated as receiving the effluent 23 from an outlet 29 of the turbine system 10, the sub-system 13 may receive the effluent 23 from more than one location, or from a different location. It should be noted that the effluent 23 received by the effluent capture and detergent regeneration sub-system 13 may be less aerated than the foam 21 used during the cleaning, as the aeration of the foam 21 may be reduced during and/or after the cleaning. The term "effluent" may be utilized herein to refer to the contents captured from the gas turbine system 10 (e.g., engine), while the term "liquid mixture" may be utilized herein to refer to the contents output by an effluent converter that reduces aeration of the effluent 23 (or, in embodiments without the effluent converter, the contents input to a filter or chemical converter, as described in detail below). In other words, the liquid mixture may be derived from the effluent. As such, it should be noted that the "liquid mixture" referred to herein (e.g., entering the sub-system 13) may generally be less aerated than the effluent 23 (e.g., leaving the turbine system 10). It should also be noted that, in some embodiments, the effluent 23 may include meta-stable foam, or a derivative thereof, that is self-collapsible at least to an extent.

In general, as will be described in detail with reference to later figures, the illustrated effluent capture and detergent regeneration sub-system 13 (of the cleaning system 11) may capture effluent 23 during or after a cleaning cycle, may convert the effluent 23 to a liquid mixture (e.g., having solids, particulate, contaminants, etc. therein), may analyze the effluent 23 or liquid mixture, may filter the liquid mixture for removal of oil, water, solids, particulate, contaminants, and organics, and may convert the liquid mixture back to the a suitable or acceptable formulation having the specification limits of the initial liquid detergent 15 (e.g., organic acid based liquid detergent, such as glycolic acid and/or citric acid based liquid detergent) utilized to form the foam 21 for cleaning the turbine system 10. In other words, a recycled/regenerated detergent in accordance with the present disclosure may include a slightly different formulation than a virgin detergent, while still having a suitable or acceptable formulation meeting certain specification limits. It is presently recognized that the capture and regeneration sub-system 13 may enable a smaller cleaning system 11

(e.g., by reducing a volume of the liquid detergent storage tank), may reduce a material cost of the liquid detergent 15 by recycling the liquid detergent 15, and may improve isolation of the solids, particulate, contaminants, and/or organics removed from the turbine system 10 for reuse or suitable disposal. It should be noted that, in the harshest environmental conditions (e.g., in dry areas), in which cleaning of the engine is generally most frequently performed, the cost of the detergent 15, water, or both may be generally higher than in more amenable environmental conditions, thereby compounding the material expense. In other words, while disclosed embodiments are generally advantageous in any environment, disclosed embodiments may facilitate an enhanced cost reduction in the harshest of environmental conditions.

Figure 2:
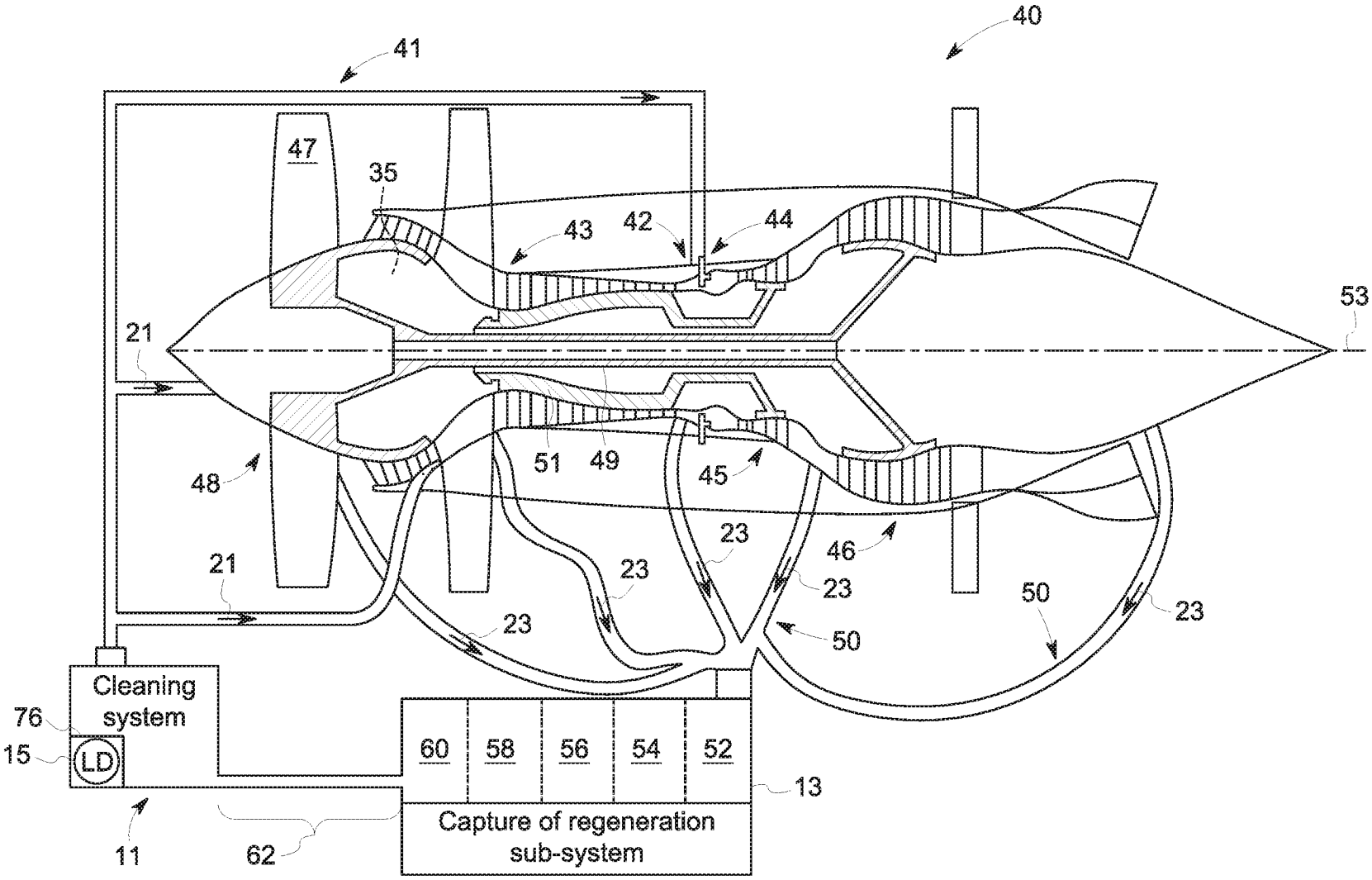
FIG. 2 is a cross-sectional schematic view of an embodiment of an aircraft gas turbine system having the cleaning system with the effluent capture and detergent regeneration sub-system of FIG. 1, in accordance with an aspect of the present disclosure.

FIG. 2 illustrates a cross-sectional schematic view of an embodiment of the cleaning system 11, the effluent capture and detergent regeneration sub-system 13 thereof, and an aircraft gas turbine engine 40 that includes a fan assembly 41 and a core engine 42 including a high pressure compressor 43, a combustor 44, a high-pressure turbine (HPT) 45, and a low-pressure turbine (LPT) 46. The illustrated aircraft gas turbine engine 40 may be an example of the gas turbine engine 10 illustrated in FIG. 1. In the illustrated embodiment, the fan assembly 41 of the gas turbine engine 40 (e.g., aircraft gas turbine engine) includes an array of fan blades 47 that extend radially outward from a rotor disk 48. The gas turbine engine 40 has an intake side (e.g., proximate the fan assembly 41) and an exhaust side (e.g., proximate the LPT 46). The fan assembly 41 and the LPT 46 are coupled by a low-speed rotor shaft 49, and the high pressure compressor 43 and the HPT 45 are coupled by a high-speed rotor shaft 51. The gas turbine engine 40 may be any type of gas or combustion turbine aircraft engine including, but not limited to, turbofan, turbojet, turboprop, turboshaft engines as well as geared turbine engines such as geared turbofans, unducted fans and open rotor configurations. Alternatively, the gas turbine engine 40 may be any type of gas or combustion turbine engine, including, but not limited to, land-based gas turbine engines in simply cycle, combined cycle, cogeneration, marine and industrial applications.

Generally, in operation, fluid flows axially through the fan assembly 41, in a direction that is substantially parallel to a centerline 53 that extends through the gas turbine engine 40, and compressed air is supplied to the high pressure compressor 43. The highly compressed air is delivered to the combustor 44. Combustion gas flow (not shown) from the combustor 44 drives the turbines 45 and 46. The HPT 45 drives the compressor 43 by way of the shaft 51, and the LPT 46 drives the fan assembly 41 by way of the shaft 49. Moreover, in operation, foreign material, such as mineral dust, is ingested by the gas turbine engine 40 along with the air, and the foreign material accumulates on surfaces therein.

Figure 3:
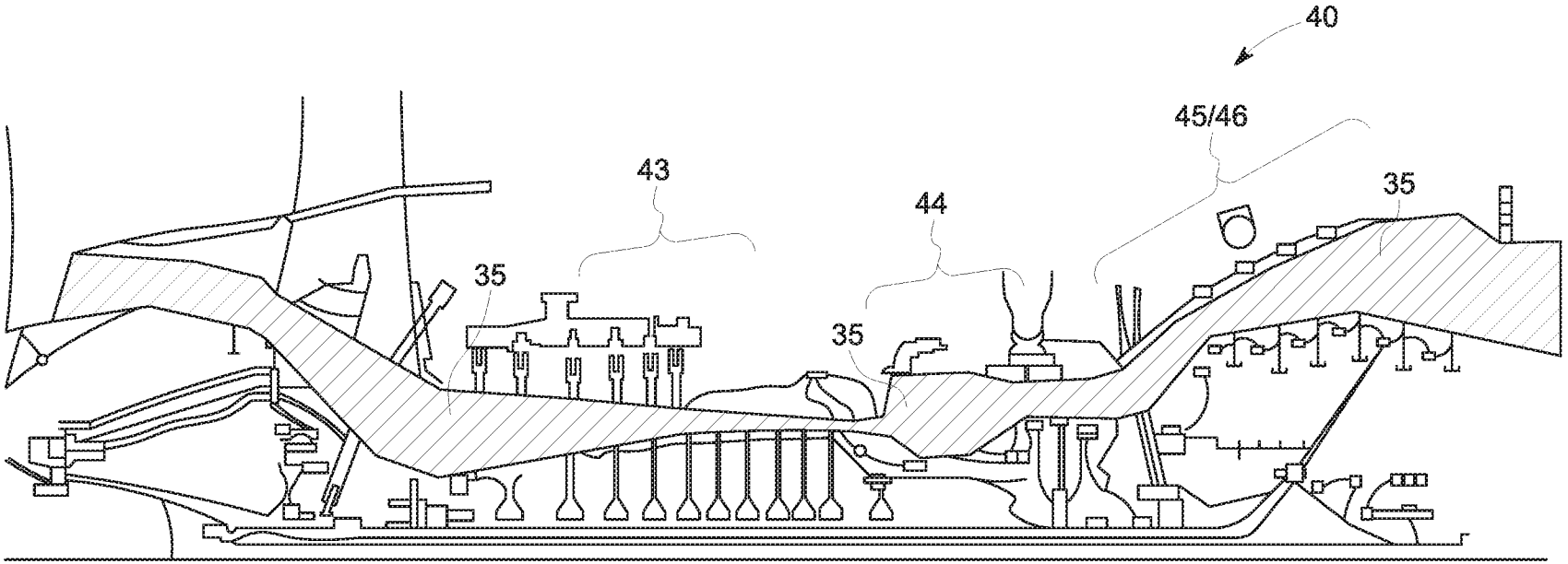
FIG. 3 is a cross-sectional schematic view of an embodiment of a cleaning volume or fluid passageway of the turbine system of FIG. 2, in accordance with an aspect of the present disclosure.

As shown, the cleaning system 11 supplies the cleaning agent (e.g., a foam 21 generated from a liquid detergent 15) to a number of inlets to the gas turbine engine 40 (e.g., to the fluid passageway 35 thereof). An example of an embodiment of the fluid passageway 35 extending continuously through various components of the gas turbine engine 40 of FIG. 2 (e.g., through at least the compressor 43, the combustor 44, and the turbine stages 44, 45) is shown in FIG. 3. The cleaning system 11 may inject or enable flow of the detergent-based foam 21 into the fluid passageway 35 along multiple locations of the gas turbine engine 40. The inlets to the fluid passageway 35 may include inlets used for other purposes, such as inlets for borescope inspections, as inlets for fuel manifold nozzles. It should also be noted that the cleaning system 11 may be utilized for cleaning the fluid passageway 35 of any gas turbine engine 40 (e.g., including the turbine system 10 of FIG. 1) in accordance with presently described embodiments.

Focusing again on the embodiment illustrated in FIG. 2, the illustrated effluent capture and detergent regeneration sub-system 13 of the cleaning system 11 may include several components, assemblies, or stages designed and arranged to process the effluent 23 resulting from the cleaning of aircraft gas turbine engine 40. For example, the sub-system 13 of the cleaning system 11 may include an effluent capture assembly 50 that generally captures effluent 23 during or after a cleaning cycle, and an effluent converter assembly 52 that generally converts the captured effluent 23 to a liquid mixture (e.g., where the liquid mixture may be less aerated than the effluent 23). It should be noted that the illustrated effluent capture assembly 50 (e.g., hoses) is a representative embodiment, and that effluent may be captured from additional or different areas or portions of the gas turbine engine 40 than shown in the illustrated embodiment.

The sub-system 13 may also include a first filtration assembly 54 that generally removes solids and particulate from the liquid mixture, a second filtration assembly 56 that generally removes organics from the liquid mixture, and an analyzer 58 (e.g., having one or more sensors 59) that generally analyzes the liquid mixture to determine its contents and composition (which may be disposed upstream or downstream of the filtration assemblies 54, 56, depending on the embodiment). The sub-system 13 may also include a chemical converter 60 that generally converts the liquid mixture back to the formulation of the initial liquid detergent 15 utilized to form the foam 21 (e.g., by adding content to the liquid mixture), and a delivery assembly 62 that generally delivers the liquid detergent 15 to a foam generator of the cleaning system.

It should be noted that the components/assemblies 50, 52, 54, 56, 58, 60, 62 may be disposed in the order shown in the illustrated embodiment, or they may be disposed in a different order. It should also be noted that components/assemblies 50, 52, 54, 56, 58, 60, and/or 62 (or controllers or control modules thereof) may collectively be referred to as "processing components" of the sub-system 13. In general, by capturing, processing, and reusing detergent 15 during or after a cleaning cycle with the components and/or assemblies of the sub-system 13 described above, a volume of the cleaning system (or detergent storage tank 76 thereof) may be reduced, thereby reducing a footprint of the cleaning system. Further, a materials cost may be substantially reduced (e.g., a detergent 15 and/or water cost is substantially reduced), and selective isolation of contaminants may be simplified and improved for later disposed or reused. These and other features will be described in detail below.

Figure 4:
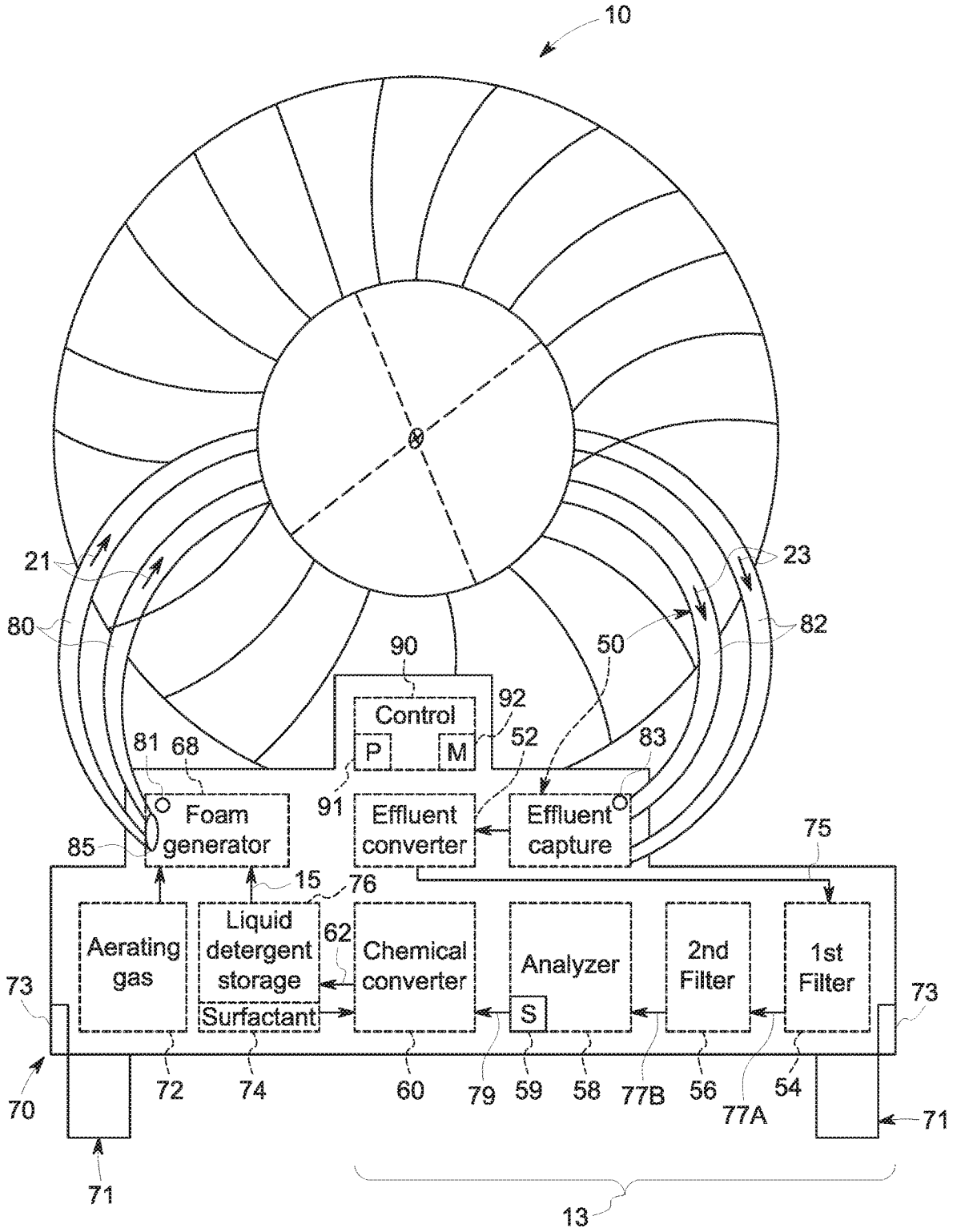
FIG. 4 is side schematic view of an embodiment of the cleaning system with the effluent capture and detergent regeneration sub-system of FIG. 1, in accordance with an aspect of the present disclosure.

Turning now to FIG. 4, a cross-sectional schematic view of an embodiment of the cleaning system 11 having the effluent capture and detergent regeneration sub-system 13 is shown. The illustrated embodiment includes a cleaning cart 70 (or some other suitable cleaning station) designed and arranged to house, protect, or otherwise provide certain (or all) of the processing components of the effluent capture and detergent regeneration sub-system 13, in addition to other components of the cleaning system 11 utilized to clean the aircraft engine 10. The cleaning cart 70 is suitably sized to be positioned beneath (or proximate to) the aircraft engine 10 (e.g., beneath a wing of the aircraft). The cleaning cart 70 may also include wheels 71 designed to facilitate transport of the cleaning cart 70. In some embodiments, extendable legs 73 may be positioned proximate the wheels 71.

As shown, the cleaning cart 70 includes several components within the cart 70 (e.g., process components configured to handle various fluids). In the illustrated embodiment, an arrow into a component illustrated within the cart 70 is referred to herein as an "input" to the component (e.g., to an inlet of the component), while an arrow out of the component illustrated within the cart 70 is referred to herein as an "output" to the component (e.g., from an outlet of the component). As shown, the cleaning cart 70 includes a foam generator 68 having one or more inlets to receive an aerating gas from an aerating gas storage tank 72, and to receive liquid detergent 15 from a liquid detergent storage tank 76 to form the foam 21. In some embodiments, a surfactant storage source 74 (e.g., tank, or other suitable container) may be coupled with, integral with, or otherwise used to provide a surfactant to the liquid detergent 15 (e.g., in the liquid detergent storage tank 76). After the foam generator 68 generates the foam 21, the foam 21 may be delivered to the engine 10 via one or more delivery hoses 80 from a foam outlet 85 of the cleaning system 11. The cart 70 may include a pump 81 associated with the foam generator 68 and the delivery hoses 80, where the pump 81 is designed to move or urge the foam 21 from the foam generator 68 to the engine 10 through the delivery hoses 80.

While (or after) the foam 21 is delivered to the engine 10, the engine 10 (or rotor components thereof) may be moved (e.g., rotated or turned) to ensure that the foam 21 reaches a larger surface area (e.g., internal surface area) of the engine 10, or components thereof, than if the engine 10 remained stationary. The foam 21 may wet or soak (e.g., wash, scrub) the engine 10 to facilitate removal of contaminants or deposits disposed in the engine 10. For example, the contaminants may include pollutants (e.g., sulfate, nitrates, etc.), evaporate deposits (e.g., halite, carbonates, etc.), and dust (e.g., aluminosilicate clays), and the foam 21 may include a particular composition suitable for removal of the pollutants, evaporate deposits, and/or dust. As previously described, organic acid based liquid detergents 15, such as glycolic acid and/or citric acid based liquid detergents, are non-limiting examples that may be suitable for generating foam 21 capable of removal of the pollutants, evaporate deposits, and/or dust described above, in certain embodiments.

As the foam 21 traverses and cleans the engine 10 (or a component to be cleaned thereof), the bubbles forming the foam 21 will eventually begin to break down. In other words, aeration of the foam 21 generally decreases as the foam 21 removes contaminants from the engine 10 during cleaning. During (or after) a cleaning cycle, effluent 23 composed of the used foam 21 and contaminants (e.g., one or more of pollutants, evaporate deposits, or dust) is removed from the engine 10. In the illustrated embodiment, the effluent 23 is removed from the engine 10 via the effluent capture assembly 50 of the effluent capture and detergent regeneration sub-system 13. For example, the effluent capture assembly 50 may include return hoses 82 that facilitate input of the effluent 23 into an effluent inlet of the cleaning cart 70. A pump 83 of the effluent capture assembly 50 may be utilized to move the effluent 23 from the engine 10 to the cart 70.

After (or while) the effluent 23 is captured by the effluent capture assembly 50, the effluent converter 52 may convert the effluent 23 to a liquid mixture. Specifically, the effluent converter 52 may convert the effluent 23 to an initial liquid mixture 75, which is output by the effluent converter 52 and input to the first filter 54. As previously described, the effluent 23 may still be partially aerated (e.g., less than the foam 21). The effluent converter 52 may further break down the effluent 23 to transform the effluent into the initial liquid mixture 75 (e.g., at this stage, a liquid including soluble and insoluble contaminants from the turbine 10). The effluent converter 52 may, for example, include a water or air flow supply that sprays the effluent to reduce aeration, thereby generating the initial liquid mixture 75. Alternatively, the effluent converter 52 may otherwise physically and/or chemically treat (e.g., via pressurization) the effluent 23 to generate the initial liquid mixture 75. However, in some embodiments, the effluent 23 may lose aeration while traveling toward the cart 70, and/or may otherwise become the initial liquid mixture 75 without an active effluent converter 52. In other words, the effluent 23 may include meta-stable foam, or a derivative thereof, that is self-collapsible at least to an extent.

The initial liquid mixture 75 may then pass through the first and second filter assemblies 54, 56. The first filter assembly 54 may be designed to remove from the initial liquid mixture 75 dissolved, dispersed, and/or emulsified hydrocarbons that are not suitable components of a liquid detergent. In other words, the hydrocarbons may require removal in order to ensure that the regenerated detergent meets certain detergent specification limits (e.g., formulation/composition specification limits). For example, the first filter assembly 54 may include an oil absorbing filter, such as a fiber filter. An example of a fiber filter that may be suitable for hydrocarbon separation is a polypropylene fiber filter. Oil absorbing filters generally include filtration efficiencies of approximately 95 percent. By including multiple stages of filters for the first filter assembly 54, 99 percent or greater filter efficiency may be achieved. In some embodiments, the first filter assembly 54 may additionally or alternatively include an ion exchange resin. In general, the first filter assembly 54 is designed to separate and remove hydrocarbons/organics without stripping away certain portions or components of the initial liquid mixture 75 included in the liquid detergent 15. Thus, it is presently recognized that a traditional activated carbon filter, which is commonly used for removal of organics, is unsuited for use in the first filter assembly 54 (e.g., hydrocarbon removal filter assembly), since it is recognized that such filters undesirably remove components of the liquid detergent 15 along with the organic contaminants. In other words, traditional carbon filters undesirably modify the formulation of the initial liquid mixture 75 to include a composition unsuitable for regenerating detergent within detergent specification limits. It is also presently recognized that fiber filters, other oil absorbing filters, and certain ion exchange resins do not have this issue, and are examples of suitable means for separation of organic contaminants (e.g., oil) in the sub-system 13.

The second filter assembly 56 receives an output 77*a* (e.g., partially filtered liquid mixture, partially purified liquid mixture) from the first filter assembly 54 following removal of the non-detergent organics, and may include a series of filters designed to remove solids and particulates therefrom. The series of filters may include decreasingly sized openings (e.g., in the lattice structure of the filter). For example, the series of filters may start with a first filter having openings sized with diameters of 100 microns, and may finish with a last filter having openings sized with diameters of 0.1 microns. In another embodiment, the series of filters may start with a first filter having openings sized with diameters of 50 microns, and may finish with a last filter having openings sized with diameters of 0.5 microns. The series of filters having decreasingly sized openings may enable size-based separation of different types of contaminants (e.g., solids and particulates) at each filter, thereby facilitating the disposal (or re-use) of individual contaminants removed from the engine 10. It should be noted that, while the first filter assembly 54 is illustrated upstream of the second filter assembly 56, in another embodiment the second filter assembly 56 may be disposed upstream of the first filter assembly 54.

In the illustrated embodiment, a purified liquid mixture 77*b* (e.g., filtered liquid mixture) is output from the second filter 56 and routed toward the analyzer 58 for analysis. The analyzer 58 may receive the purified liquid mixture 77*b* and analyze the contents of the purified liquid mixture 77*b*. For example, the analyzer 58 may determine the contents of the purified liquid mixture 77*b*, and whether any particular component (e.g., dissolved, insoluble, and/or organic) of the liquid mixture 77*b* is above a threshold amount suitable for foam generation and utilization cleaning in the engine 10. In particular, in certain embodiments, the analyzer 58 may determine an amount of potassium (K), chlorine (Cl), sodium (Na), and phosphorus (P) present in the liquid mixture.

As previously described, the analyzer 58 determines the composition of the purified liquid mixture 77*b*. In certain embodiments, the analyzer 58 may determine a pH of the purified liquid mixture 77*b*, and may determine whether any particular component of the purified liquid mixture 77*b* is above a threshold amount suitable for foam generation and utilization in the engine 10. In particular, the analyzer 58 may determine an amount of potassium (K), chlorine (Cl), sodium (Na), and phosphorus (P). The analyzer 58 may be disposed upstream or downstream of the first and second filter 54, 56, depending on the embodiment. In other words, the analyzer 58 may analyze either the purified liquid mixture 77*b* output by the second filter 56, or the initial liquid mixture output by the effluent converter 52 (or effluent capture system 50).

The purified liquid mixture 77*b*, which may no longer contain a substantial amount of organics, solids, and particulates (or at least having only trace amounts thereof), is passed as an output 79 (e.g., from the analyzer 58, or from the second filter 56 in embodiments where the analyzer 58 is disposed upstream of at least one of the filters 54, 56) to the chemical converter 60 of the effluent capture and detergent regeneration sub-system 13 fluidly coupled to the analyzer 58. The chemical converter 60 may facilitate correction of the pH to levels acceptable of the liquid detergent 15 utilized for foam generation (e.g., via addition of acid or base). Further, the chemical converter 60 may restore the detergent chemistry, for example by mixing surfactant content (as shown), and/or restoring a corrosion inhibitor. In general, the chemical converter 60 restores the initial formulation of the liquid detergent 15 by adding material or content to the purified liquid mixture 77*b* (e.g., where the purified liquid mixture 77*b* is the output 79 of, for example, the analyzer 58). The chemical converter 60 may act based on instructions received from a control module 90 of the cart 70, where the control module 90 may receive data from the analyzer 58 regarding the composition of the purified liquid mixture 77*b* or the initial liquid mixture 75. In other words, the chemical converter 60 may treat the fluid (e.g., add material or content to the fluid) received by the chemical converter 60 based on control signals from the control module 90 in response to data received by the control module 90 from the analyzer 58. In some embodiments, the analyzer 58 may be a component of (or incorporated with) the control module 90.

The control module 90 includes a processor 91 and a memory 92, where the memory 92 is configured to store instructions that, when executed by the processor 91, cause the control module 90 to perform certain acts. For example, the control module 90 may be configured to communicate with various components (e.g., processing components, suitable sensors) of the cart 70 via wired or wireless connection, in order to instruct the components of the cart 70 to perform various functions. Although the control module 90 may include other functionality, the control module 90 may be referred to (along with components/assemblies 50, 52, 54, 56, 58, 60) as a processing component of the sub-system 13.

After the chemical converter 60 restores the composition of the liquid detergent 15 (e.g., by adding materials or content), the liquid detergent 15 is transported from the chemical converter 60 to the liquid detergent storage tank 76 via the delivery assembly 62. As previously described, a pump (e.g., pump 81, pump 83, or some other suitable pump or flow-urging device) may facilitate transport of the fluids within the cart 70. Further, as previously described, the cart 70 includes in-line effluent capture and detergent regeneration capabilities, such that the cart 70 generates foam 21, pushes the foam 21 to and from the engine 10, and converts the resulting effluent 23 back to the liquid detergent 15, all during a single cleaning, in certain embodiments. In other words, while traditional cleaning systems that do not have detergent regeneration require large detergent storage tanks, the disclosed cleaning system 11 (and sub-system 13 thereof) may reduce the required volume of the storage tank by at least 50%.

Figure 5:
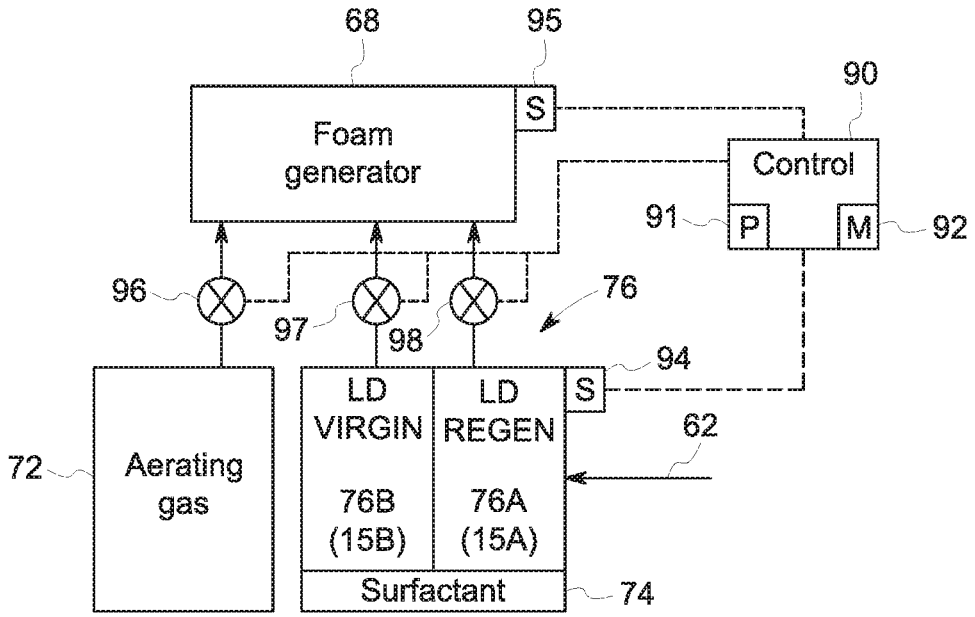
FIG. 5 is a side schematic view of an embodiment of a portion of the cleaning system of FIG. 1, in accordance with an aspect of the present disclosure.

Turning now to FIG. 5, a side schematic view of a portion of an embodiment of the cleaning system 11 of FIG. 1 is shown. The illustrated portion of the cleaning system 11 of FIG. 1 includes the foam generator 68, liquid detergent tank 76, aerating gas tank or source 72, and controller 90. In the illustrated embodiment, the liquid detergent tank 76 includes a regenerated liquid detergent tank 76A (having regenerated liquid detergent 15A), and a virgin liquid detergent tank 76B (having virgin liquid detergent 15B) separate from the regenerated liquid detergent tank 76A. Regenerated liquid detergent 15A derived from the regeneration systems and methods shown in (and described with reference to) FIGS. 1-4 may be routed to the regenerated liquid detergent tank 76A, while fresh liquid detergent may be disposed in the virgin liquid detergent tank 76B. The illustrated controller 90 may determine an amount of the virgin liquid detergent 15B, and an amount of the regenerated liquid detergent 15A, to be routed toward the foam generator 68. The virgin liquid detergent 15B and the regenerated liquid detergent 15A may be mixed in, or upstream of, the foam generator 68.

For example, the controller 90 may utilize control feedback to determine the amount of regenerated liquid detergent 15A and the amount of virgin liquid detergent 15B that should be routed to the foam generator 68 at any given time. One or more sensors 94, 95 may provide the controller 90 with the data by which the controller 90 determines the above-described amounts. For example, a regenerated liquid detergent sensor 94 may detect a parameter of the regenerated liquid detergent 15A in (or prior to being received by) the regenerated liquid detergent tank 76A. The parameter of the regenerated liquid detergent 15A may be, for example, indicative of a composition of the regenerated liquid detergent 15A (e.g., a ratio of various constituents or elements of the regenerated liquid detergent 15A). Additionally or alternatively, a foam generator sensor 95 may detect a parameter of the foam being generated in the foam generator 68. The parameter of the foam may be, for example, indicative of a composition of the foam, a bubble size of the foam, or some other parameter of the foam, such as density.

The controller 90 may receive data indicative of the parameter(s) described above from one or more of the sensors 94, 95. Based on the data, the controller 90 may instruct actuation of a valve 97 in fluid communication between the virgin liquid detergent tank 76B and the foam generator 68 (e.g., to enable flow of the virgin liquid detergent 15B), a valve 98 in fluid communication between the regenerated liquid detergent tank 76A and the foam generator 68 (e.g., to enable flow of the regenerated liquid detergent 15A), a valve 96 in fluid communication between the aerating gas 72 and the foam generator 68 (e.g., to enable flow of the aerating gas), or any combination thereof.

In some embodiments, and/or during some operating modes, the controller 90 may instruct one or more of the valves 96, 97, 98 based on a pre-defined ratio that does not involve control feedback. For example, the controller 90 may instruct the valves 97, 98 to enable a 1:1 ratio (or some other ratio) between the virgin liquid detergent 15B and the regenerated liquid detergent 15A. It should be noted that other control mechanisms besides the illustrated valves 96, 97, 98 may also be possible (e.g., a header, a three-way valve, etc.). Further, it should be noted that the virgin liquid detergent tank 76B and the regenerated liquid detergent tank 76A may be separate tanks (e.g., compartments) integrated into one structure, or the virgin liquid detergent tank 76B and the regenerated liquid detergent tank 76A may be separate tanks having separate structures. Further still, it should be noted that the tank 76 (and corresponding control features) illustrated in FIG. 5 may be utilized in the preceding embodiments (e.g., illustrated in FIGS. 1-4).

Figure 6:
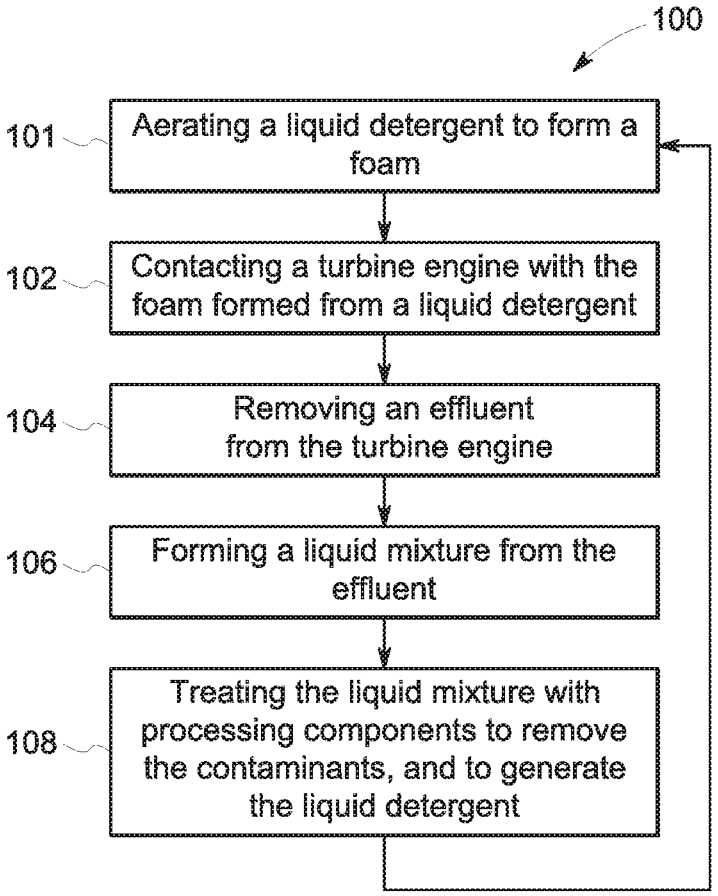
FIG. 6 is a process flow diagram illustrating an embodiment of a method of cleaning a turbine system with a cleaning system having an effluent capture and detergent regeneration sub-system, in accordance with an aspect of the present disclosure.

Turning now to FIG. 6, a process flow diagram illustrating a method 100 of cleaning a turbine engine with a foam generated from a liquid detergent (e.g., organic acid based liquid detergent, such as glycolic acid and/or citric acid based liquid detergent) is shown. In the illustrated embodiment, the method 100 includes aerating (block 101) a liquid detergent (e.g., organic acid based liquid detergent, such as glycolic acid and/or citric acid based liquid detergent) to form the foam. For example, a foaming chamber may receive the liquid detergent, an aerating gas, or both through aerating nozzles of the foaming chamber, which facilitate formation of the aerated foam.

The method 100 also includes wetting, soaking, or otherwise contacting (block 102) the turbine engine with the foam to remove contaminants from the turbine engine, thereby generating an effluent having the contaminants. As previously described, in certain embodiments, rotor components of the turbine engine may be rotated as the foam is introduced, such that the foam covers a larger internal area of the components of the turbine engine being cleaned.

The method 100 also includes removing (block 104) the effluent from one or more outlets of the turbine engine. For example, as previously described, the effluent (e.g., having the contaminants) may be flushed, pumped, rinsed, or otherwise removed from the one or more outlets of the turbine engine. The method 100 also includes converting (block 106) the received effluent into an initial liquid mixture that includes contaminants (e.g., soluble, insoluble, organic). It should be noted that the forming of the liquid mixture from the effluent may be a part of the removal process of the effluent. For example, as the foam soaks or otherwise contacts the components of the turbine engine, the foam may lose some aeration (e.g., the bubbles of the foam may deteriorate). Thus, the effluent may be a less aerated form of the foam, but may also include contaminants therein that are scrubbed, stripped, or otherwise removed from the turbine components. As such, the liquid mixture may be a less (or non-) aerated form of the effluent. The effluent may be converted to the liquid mixture via an air blower, a water rinse, a pressurizer, or some other suitable means for reducing aeration.

The method 100 also includes treating (block 108) the liquid mixture with processing components to remove the contaminants, and to regenerate the liquid detergent. As previously described, the effluent capture and detergent regeneration sub-system may include several processing components designed to form the liquid detergent from the liquid mixture. For example, as set forth above, several filters may be utilized to separate organics (e.g., oil), particulate, dust, pollutants, and/or other contaminants from the liquid mixture. The processing components may include an analyzer that analyzes a composition of the liquid mixture, and provides data indicative of the composition to a controller of the processing components. For example, the analyzer may determine an amount of dissolved ions (e.g., K, Cl, Na, and P) in the liquid mixture, determine a pH level of the liquid mixture, determine the presence (and/or amount) of a surfactant, determine the presence (and/or amount) of a corrosion inhibitor, or any combination thereof. The controller may receive the data from the analyzer, and may instruct certain other of the processing components described above, based on the data received, to perform their respective acts. Further, a chemical converter adds materials or content to the liquid mixture to adjust a pH level of the liquid mixture, adjusts an amount of surfactant in the liquid mixture, restores a corrosion inhibitor of the liquid mixture, or some combination thereof.

In other words, the system may be closed loop, and the liquid detergent (and resulting foam) may be utilized more than once during a single cleaning cycle. Thus, although a flow path of the components of the turbine engine that require cleaning may require a first volume of liquid detergent, the liquid detergent storage tank may be sized to contain less than the first volume of liquid detergent, thereby reducing a footprint of the storage tank and corresponding cleaning system. Thus, disclosed systems and methods reduce a footprint of the components required for cleaning a gas turbine engine, reduce a material cost of the liquid detergent (e.g., organic acid based liquid detergent, such as glycolic acid and/or citric acid based liquid detergent), utilized by the disclosed systems and methods, and improve removal, disposal of, and/or reuse of contaminants or other products that are not a part of the liquid detergent.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine engine cleaning system, comprising:

a foam generator configured to generate foam, from a liquid detergent, to clean a turbine engine; and an effluent capture and detergent regeneration sub-system having an inlet configured to receive an effluent from the turbine engine, one or more processing components configured to process the effluent to regenerate the liquid detergent, and an outlet fluidly coupled with the foam generator and configured to enable transport of the liquid detergent from the effluent capture and detergent regeneration sub-system to the foam generator, wherein the one or more processing components comprise a chemical converter configured to add a surfactant to a liquid mixture derived from the effluent to regenerate the liquid detergent.

2. The turbine engine cleaning system of claim 1, wherein the foam generator and the effluent capture and detergent regeneration sub-system are configured to be operated simultaneously such that at least a portion of the liquid detergent is utilized by the foam generator to generate the foam twice during a single cleaning cycle of the turbine engine.

3. The turbine engine cleaning system of claim 1, wherein the foam generator is configured to be fluidly coupled with the turbine engine to supply the foam, and wherein the foam becomes the effluent during or after a cleaning cycle.

4. The turbine engine cleaning system of claim 1, wherein the one or more processing components comprise an effluent converter configured to convert the effluent to the liquid mixture.

5. The turbine engine cleaning system of claim 4, wherein the one or more processing components comprise an analyzer configured to analyze a composition of the liquid mixture.

6. The turbine engine cleaning system of claim 5, wherein the analyzer is, or comprises, a control module configured to communicate with the one or more processing components to instruct the one or more processing components based at least in part on data gathered by the analyzer and indicative of the composition of the liquid mixture.

7. The turbine engine cleaning system of claim 1, wherein the one or more processing components comprise a filter assembly configured to separate solids and particulate from the liquid mixture derived from the effluent.

8. The turbine engine cleaning system of claim 7, wherein the filter assembly comprises a series of filters having lattice structures with openings that decrease in size with each successive filter in a downstream direction.

9. The turbine engine cleaning system of claim 8, wherein the openings comprise diameters sized between 100 and 0.1 microns.

10. The turbine engine cleaning system of claim 1, wherein the one or more processing components comprise a filter assembly configured to separate an organic compound from the liquid mixture derived from the effluent.

11. The turbine engine cleaning system of claim 10, wherein the filter assembly comprises an oil absorbing filter or an ion exchange resin filter.

12. The turbine engine cleaning system of claim 1, wherein the one or more processing components further comprise the chemical converter configured to add material or content to the liquid mixture derived from the effluent to generate or reformulate the liquid detergent for use by the foam generator.

13. The turbine engine cleaning system of claim 12, wherein the chemical converter is further configured to treat the liquid mixture by restoring a pH level of the liquid mixture, by restoring a corrosion inhibitor to the liquid mixture, or a combination thereof.

14. A method of cleaning a turbine engine with a foam generated from a liquid detergent, the method comprising:

contacting an internal passageway of the turbine engine with the foam generated by a foam generator to remove contaminants from the turbine engine, thereby generating an effluent having the contaminants;

removing the effluent from the turbine engine using an inlet of an effluent capture and detergent regeneration sub-system;

forming a liquid mixture from the effluent using one or more processing components of the effluent capture and detergent regeneration sub-system such that the liquid mixture comprises the contaminants; and treating the liquid mixture with the one or more processing components to remove the contaminants, and to generate the liquid detergent.

15. The method of claim 14, wherein the turbine engine is contacted by the foam and the liquid detergent is generated from the liquid mixture simultaneously during at least a portion of a single cleaning cycle of the method.

16. The method of cleaning the turbine engine of claim 14, comprising aerating the liquid detergent with an aerating gas to generate the foam.

17. The method of claim 14, wherein treating the liquid mixture with processing components to remove the contaminants comprises filtering the liquid mixture to remove a particulate, evaporate deposits, organics, dust, or a combination thereof.

18. The method of claim 14, wherein treating the liquid mixture with processing components to generate the liquid detergent comprises providing an acid or base to adjust a pH level of the liquid mixture, providing surfactant, providing a corrosion inhibitor, or a combination thereof.

19. The method of claim 18, comprising analyzing, via an analyzer, a composition of the liquid mixture, wherein treating the liquid mixture with processing components comprises instructing, with a controller, a chemical converter to treat the liquid mixture in response to data received by the controller from the analyzer.

20. A cleaning cart housing components utilized during a cleaning cycle of a turbine engine with a foam generated from a liquid detergent, the components configured to regenerate the liquid detergent from an effluent output of the cleaning cycle, wherein the cleaning cart comprises:

a foam generator configured to aerate the liquid detergent to generate the foam; and an effluent capture and detergent regeneration sub-system having one or more processing components configured to receive the effluent output, to treat the effluent output to generate the liquid detergent, and to deliver the liquid detergent to a liquid detergent storage tank in fluid communication with the foam generator, wherein the components comprise a chemical converter configured to add a surfactant to a liquid mixture from the effluent output to regenerate the liquid detergent.

* * * * *